United States Patent [19]

Merrick

[11] 4,131,100

[45] Dec. 26, 1978

[54] MULTIPLE SPARK DISCHARGE CIRCUITRY

[75] Inventor: James W. Merrick, El Paso, Tex.

[73] Assignee: Autotronic Controls, Corp., El Paso, Tex.

[21] Appl. No.: 791,098

[22] Filed: Apr. 26, 1977

[51] Int. Cl.[2] ..... F02P 1/00

[52] U.S. Cl. ..... 123/148 E; 123/148 CB; 315/209 CD; 315/209 T

[58] Field of Search ..... 123/117 R, 117 D, 148 CB, 123/148 E; 315/209 T, 209 CD

[56] References Cited

U.S. PATENT DOCUMENTS

| | | | |
|---|---|---|---|
| 3,564,581 | 2/1971 | Winterburn | 123/148 CB |
| 3,593,696 | 7/1971 | Guido | 123/148 E |
| 3,599,616 | 8/1971 | Oishi et al. | 123/148 CB |
| 3,926,165 | 12/1975 | Merrick | 123/148 E |

*Primary Examiner*—Charles J. Myhre
*Assistant Examiner*—Tony M. Argenbright
*Attorney, Agent, or Firm*—Marcus L. Bates

[57] ABSTRACT

A multi-strike spark discharge system which is combined with an internal combustion engine to produce a plurality of high voltage discharges across the spark gap of the engine. A timing signal associated with the engine is treated and used to actuate a duration control circuit which in turn actuates a repetition rate control circuit thereby controlling the duration and frequency of the discharges across the spark gap. At low rpm the repetition rate control apparatus provides several multi-discharges which enhances the combustion process and improves the operation of the combination.

19 Claims, 52 Drawing Figures

MULTIPLE SPARK DISCHARGE CIRCUITRY

RELATED PRIOR ART

U.S. Pat. No. 3,926,165 issued on Dec. 16, 1975, and the art cited therein.

BACKGROUND OF THE INVENTION

Multi-strike spark discharge systems for internal combustion engines are known in the art as exemplified by my previously issued U.S. Pat. No. 3,926,165 and to the art of record cited therein. In practicing these various previous inventions, it has been noted that the timing input signal is sometime erratic or unstable, as for example as may be caused by point bounce and extraneous background interference, which accounts for a substantial reduction in efficiency of operation.

Further, the spark discharge, for some unaccountable reason, often fails to initiate combustion, whereupon the combustion gases in the cylinders are exhausted in uncombusted condition which further accounts for inefficiency of operation.

In overcoming the above drawbacks of the prior art ignition systems, several unique circuits have manifested themselves which decidedly enhance the operation of the instant improved multistrike ignition system, and these and other improvements are the subject of this invention.

SUMMARY OF THE INVENTION

This invention relates to automotive ignition systems, and specifically to a multi-strike ignition system which produces a plurality of ignition sparks at the spark gaps of an internal combustion engine in proper timed sequence with the power stroke thereof. The engine provides an input timing signal for the ignition system which is treated by the circuitry to eliminate all undesirable characteristics from the wave form thereof, thereby providing a signal which actuates a duration control circuit. The duration control circuit provides a signal for a repetition rate control circuit which determines the number of discharges which occur during a specific number of degrees of rotation of the engine crankshaft. The repetition rate control turns the high tension discharge circuit on and off to provide the multi-strike aspect of the ignition system.

In one form of the invention, a power darlington switching transistor is connected in series with an ignition coil, ballast resistor, and the storage battery. The transistor conducts and current flows through the coil thereby building up a field of flux. When the ignition breaker points open, the electronic timing function becomes operative for a definite period of time. During this period of operation the timing circuit will turn an electronic switch, in the form of the power darlington, off and on at fixed intervals. Each time the darlington is turned off the flux field in the coil collapses inducing a high discharge voltage in the secondary winding of the coil with the resultant spark occurring at the spark plug. These voltage discharges or pulses for each engine firing will vary in number with engine speed, with more pulses occurring at relatively lower engine speeds.

Therefore, a primary object of the present invention is the provision of a multi-spark discharge system for an internal combustion engine which initiates combustion within a combustion chamber thereof in an improved manner whereupon the combustion process is carried out more efficiently than was heretofore possible.

Another object of the invention is the provision of a multi-spark discharge system which treats the incoming timing signal electrically to eliminate misfires in the combustion chamber.

A further object of this invention is to disclose and provide a multiplicity of sparks at all engine speeds and a greater multiplicity of sparks at slow speeds to thereby obviate misfires of the combustible mixture contained within the combustion chamber.

A still further object of this invention includes means for preventing cross-firing of the ignition plugs at high engine rpm's.

Another and still further object of this invention is to provide control of the duration of the time within which the sparks occur, and further providing control of the number of sparks which occur during the timed duration.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
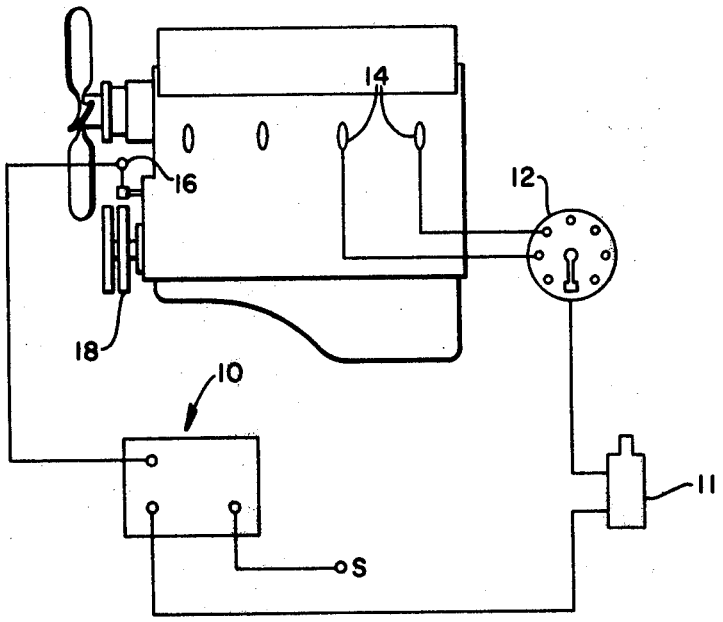
FIG. 1 is a part diagrammatical, part schematical illustration of an electronic ignition system in conjunction with an internal combustion engine.

FIG. 1 diagrammatically discloses an electronic ignition system 10 made in accordance with one of the several embodiments of the present invention. The ignition system is connected to a source S of suitable current and to a high tension coil 11. The coil secondary is connected to a distributor 12, the current of which in turn is sequentially electrically connected to each of the spark plugs 14 of the illustrated internal combustion engine. A magnetic sensing device 16 is placed in proximity to a trigger wheel 18 thereby providing a timing input signal for the circuitry 10. Apparatus 16 and 18 may be made in accordance with patent application Ser. No. 764,417 filed Jan. 31, 1977; or alternatively, may instead be the usual breaker points of an automotive type ignition system.

Figure 2:
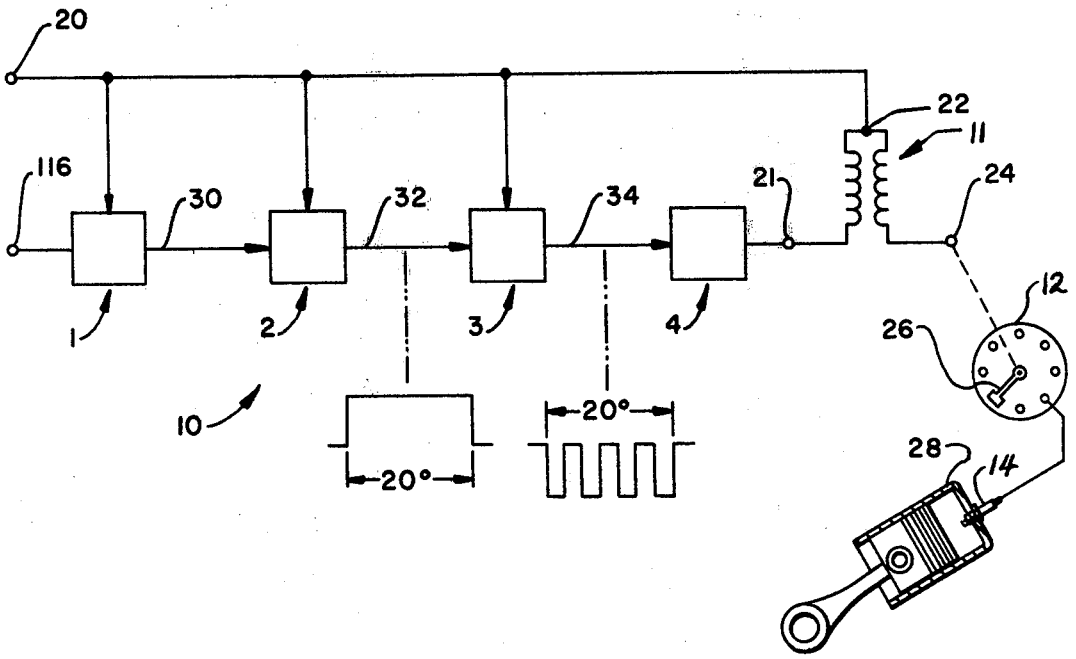
FIG. 2 is a diagrammatical representation of part of the apparatus disclosed in FIG. 1.

In FIG. 2, numeral 20 indicates a source of current, as for example, from the ignition switch. The electrical connection indicated by numeral 116 is connected to the distributor points. The distributor points are therefore connected to an input signal conditioner 1 which provides a particular signal for a duration control 2. The duration control determines the lapsed time during which multisparks will occur at junction 24, and provides a signal to the repetition rate control 3. The repetition rate control triggers the high voltage current limiting switch 4 which in turn produces a signal at junction 21 which provides the high tension coil 22 with the proper voltage characteristics.

The high tension coil produces a high tension voltage at 24 for the distributor 12. The distributor includes the rotor 26 which sequentially connects the high tension current in proper timed relationship to a spark gap, such as a plug 14 of an internal combustion engine 28.

Figure 3:
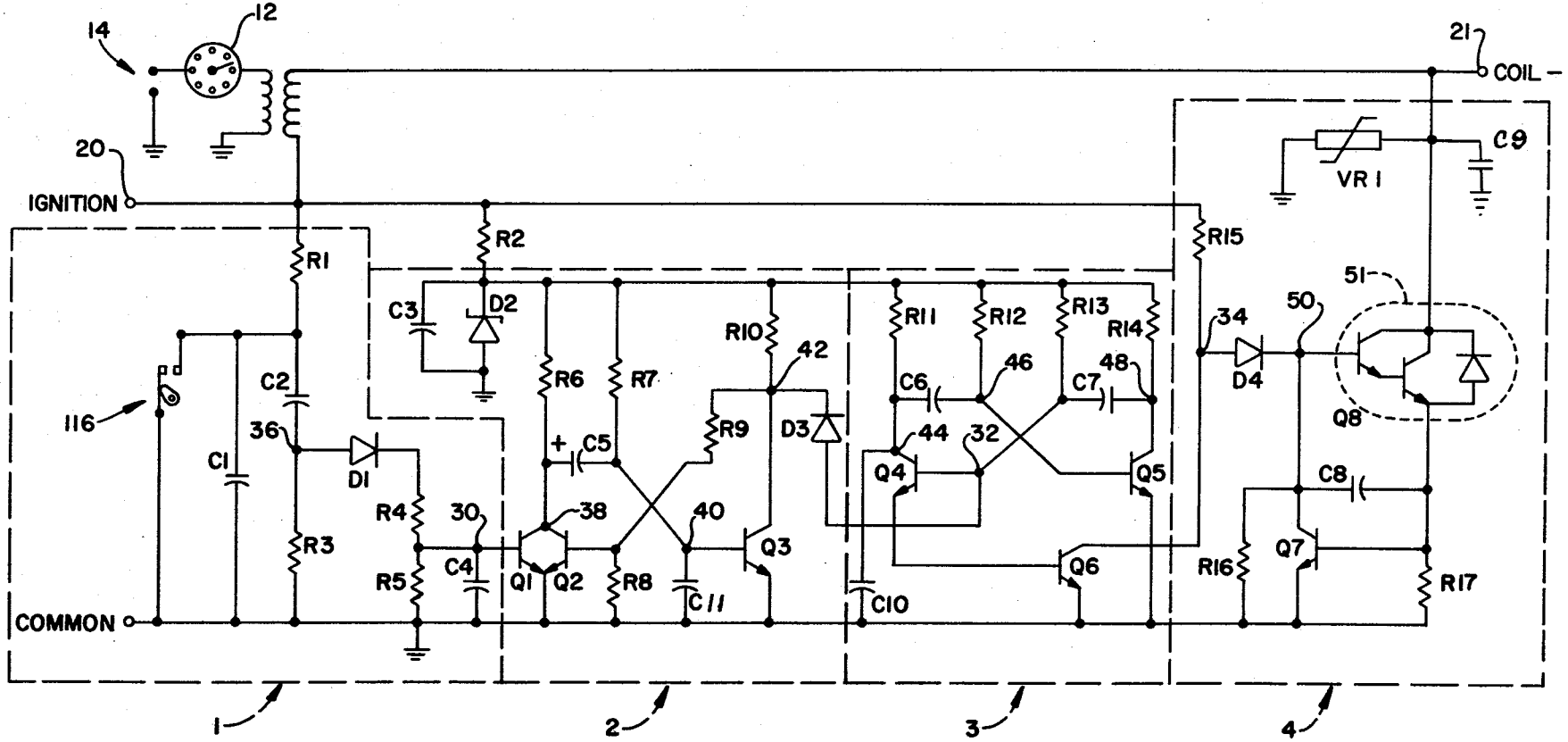
FIG. 3 sets forth the details of circuitry made in accordance with the present invention.

The electrical connections 30, 32, 34 as well as the circuit blocks 1, 2, 3, 4 and some others of the before mentioned numerals are more specifically disclosed in FIG. 3. The signal seen at 32 in FIG. 2 is a single pulse having a duration of 20° crankshaft rotation. This duration control signal causes the repetitive rate control 3 to produce the indicated repetitive signal at 34, which is comprised of a plurality of square waves having a duration of 20° of crankshaft rotation.

The block 1 circuitry of FIG. 3 includes ordinary ignition breaker points 116. When the points open the input signal conditioner triggers the duration control of block 2, which fires the ignition. Block 1 further includes a point bounce eliminator which is comprised of D1 and R3. When the points open, the signal rapidly increases as seen in FIG. 5A. As seen in FIG. 3, the signal is coupled to junction 36 by means of capacitor C2 and thence to the base of a transistor Q1, thereby triggering this transistor. When the points close, C2 discharges through R3. Should the points momentarily bounce open again, this undesirable action cannot retrigger the ignition because the capacitor has not yet fully discharged and there will accordingly be insufficient signal strength available to retrigger Q1. This is best seen in the curve of FIG. 5B, noting the long slope occasioned by the −15v.

Accordingly, the block 1 circuitry of FIG. 3 eliminates false triggering due to point bounce and provides a small trigger pulse for triggering the firing duration control seen in Block 2 of FIG. 3.

In FIG. 3, the voltage at the points 116 is illustrated in FIG. 5A and the voltage characteristics at junction 36 is illustrated by curve 36 in FIG. 5B. The signal at the junction 30 of block 1 is seen at curve 30 of FIG. 5C.

The firing duration control circuitry indicated by block 2 of FIG. 3 controls the time interval of the repetition rate control seen in block 3. The ratio of R7/R6, or the ratio of the amperage thereof, determines the duration of firing, and by sizing the particular R6 and R7 as indicated, a firing duration of 20° of crankshaft rotation is achieved.

In block 2 of FIG. 3, the voltage characteristics at junctions 38, 40, and 42, respectively, are illustrated by curves 34, 40, and 42, respectively, of FIGS. 5D–5F.

Block 3 is a multiple spark circuit that triggers the power darlington 51 on and off so that a plurality of sparks can be obtained during the duration provided by block 2. The circuitry is essentially a gated multivibrator which produces a first pulse which is longer than the succeeding ones as illustrated in FIGS. 5G–5K. This expedient provides a first spark of sufficient duration for igniting the combustibles, regardless of the rpm of the internal combustion engine. Furthermore, at lower rpm the first ignition spark is followed by a series of sparks. Therefore, at lower rpm, if for some reason the first spark fails to ignite the combustibles, the succeeding sparks will go ahead and initiate combustion.

Figure 5:
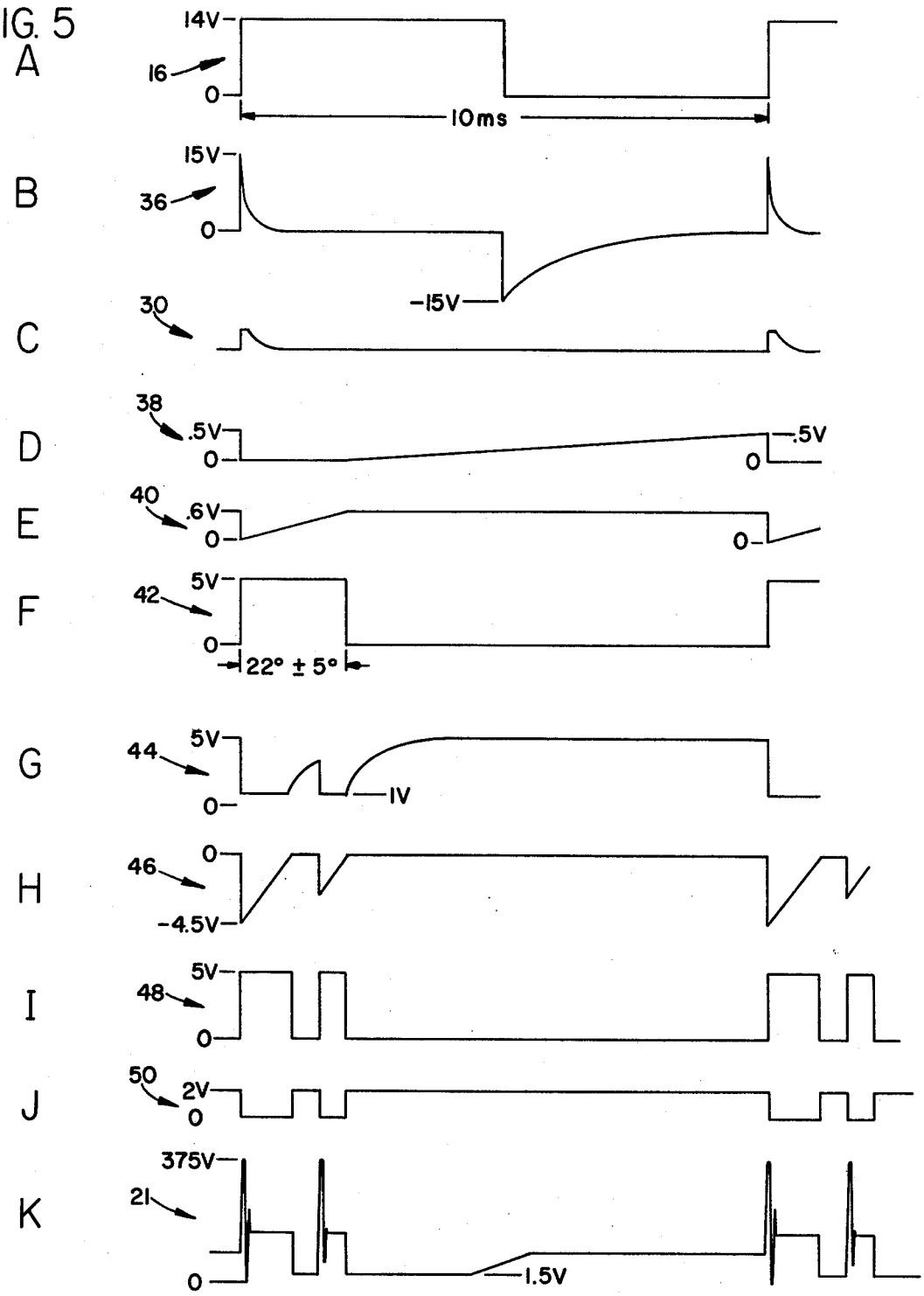
FIGS. 5A–5K are a series of curves showing the voltage characteristics at various selected places throughout the circuitry of FIGS. 3 and 4.

This situation is achieved by making the time constant of the circuit comprising R11 and C6 about the same as the time constant as of the circuit comprising R12 and C6. By making the R11 and C6 time constant shorter than the R13 and C7 time constant, between firings C6 is prevented from charging back up completely which thereby causes the succeeding sparks to be of shorter duration as seen in FIG. 5.

In block 3 of FIG. 3, the voltage characteristics at junctions 44, 46, and 48, respectively, is illustrated by curves 44, 46, and 48, respectively, of FIGS. 5G–5I.

In the high voltage circuitry of Block 4, when the current through the power darlington 51 attains a predetermined value, Q7 begins to turn on and shunts the current away from the base of the darlington, thereby limiting the current flow therethrough. When the voltage across R17 exceeds the voltage required to turn Q7 on, the current no longer increases and Q7 shunts the base current away from the darlington to limit the current flow therethrough. R17 is designed whereby the resistance increases proportional to its temperature so that it is a current limiting device for the high voltage switching circuitry. Q7 is mounted onto the same heatsink as the power darlington and accordingly, the hotter Q7 becomes, the less voltage is required at the base thereof in order to turn off the power darlington. Therefore, Q7 is also a thermal limiting device and should it commence to overheat, the current through the darlington will be reduced in proportion to the temperature rise. VR-1 in FIG. 3 is a voltage limiter for preventing the power darlington from exceeding its rated voltage.

This is a desirable attribute in that during cold weather the current limiting aspects limits the current flow at the higher value thereby providing a hotter spark until the circuitry components reach equilibrium.

Figure 4:
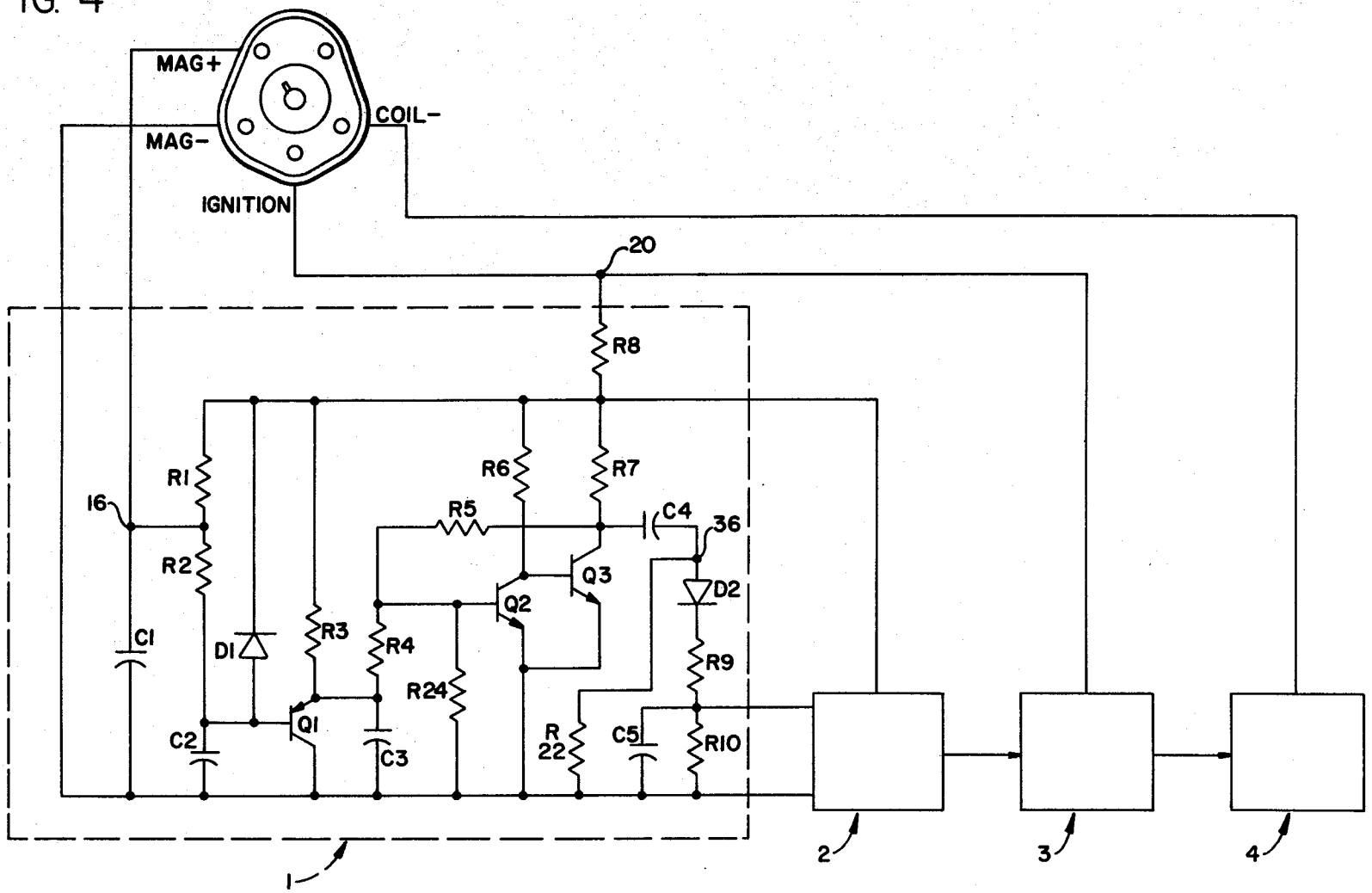
FIG. 4 is similar to FIG. 3 and sets forth a modification thereof.

FIG. 4 illustrates one means by which the circuitry previously disclosed in FIG. 3 can be used in conjunction with a magnetically actuated ignition timer apparatus. As seen in FIG. 4, block 1 is comprised of a magnetic input circuit connected to a magnetic timer such as marketed by the Chrysler Corporation.

Blocks 2, 3, and 4 of FIG. 4 are duplicated at blocks 2, 3, and 4 in FIG. 3 and therefore needs no further illustration in this disclosure.

Figure 6:
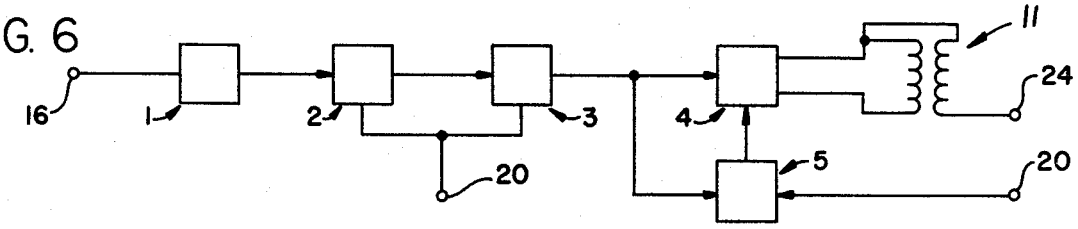
FIG. 6 is a diagrammatical illustration of another embodiment of an electronic ignition system made in accordance with the present invention.
Figure 7:
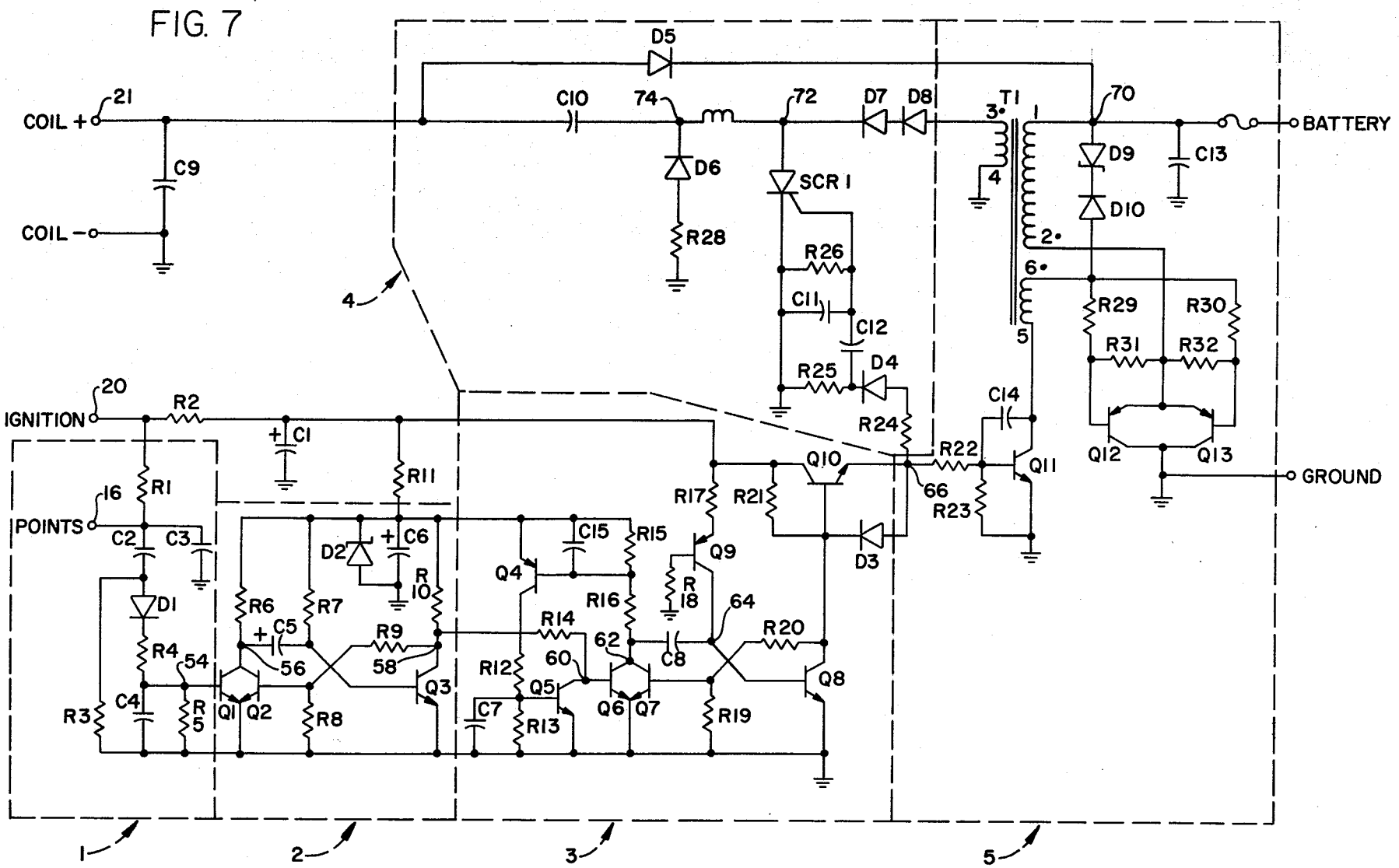
FIG. 7 is a schematical representation which sets forth the details of circuitry made in accordance with the embodiment of FIG. 6.

In FIGS. 6 and 7, blocks 1 and 2 are essentially the same as previously disclosed in FIGS. 2, 3, or 4. Block 3 of FIGS. 6 and 7 is a multifiring unit which fires the discharge circuit of Block 4. Block 5 is a DC-DC converter, or electronic switch, connected to the discharge circuit. Numeral 20 indicates a source of power such as the battery of the vehicle.

As seen in the specific details of FIG. 7, block 3 comprises a multifiring unit which turns on Q11 of Block 5. When Q11 turns on, energy is stored in the inductance of T1 and at the same time the SCR fires thereby making the first discharge from the previously stored charge at C10 through the ignition coil line 21.

Q10 drives Q11 to build up energy in T1 and also drives SCR1 through D4. These components of the circuitry make the first discharge seen at FIG. 8H, for example. Q6, 7, and 8 constitute a single shot which turns on Q10 for a period of time that is inversely proportional to the battery voltage. This causes the same amount of energy to be stored in T1 regardless of normal battery voltage variations thus improving starting. T1 is a known inductance, and Q11, 12, and 13 essentially puts battery voltage across terminals 1 and 2 of the primary T1.

The single shot therefore drives the DC/DC converter of block 5 to store the energy in the transformer and simultaneously triggers the SCR, thereby discharging C10 into the primary of the ignition coil and thus to the spark gap where the energy is dissipated. Resonance between the energy storage capacitor C10 and the ignition coil primary is prevented by D5 thus providing single polarity long duration sparks.

In FIGS. 8A–8M there are disclosed a number of different curves illustrating the voltage characteristics at selected points in the circuitry of FIG. 7. For example, the voltage characteristics at junctions 52, 54, 56, 58, 60, 62, 64, respectively, of FIG. 7 are illustrated by curves 52, 54, 56, 58, 60, 62, and 64, respectively, of FIGS. 8A–8H.

Figure 8:
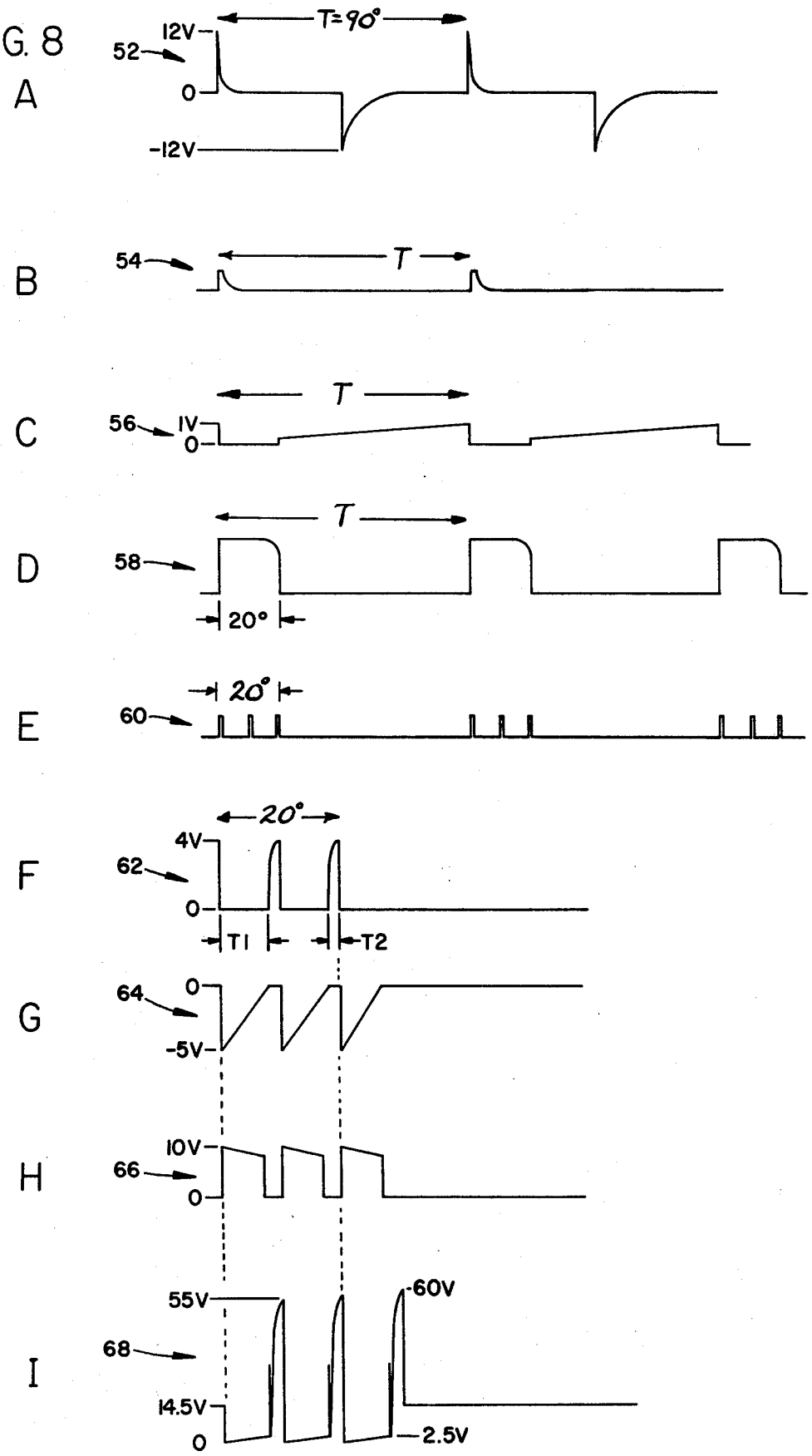
FIGS. 8A–8M are individual curves which illustrate the voltage characteristics at various specific places throughout the circuitry of FIG. 7.
Figure 8:
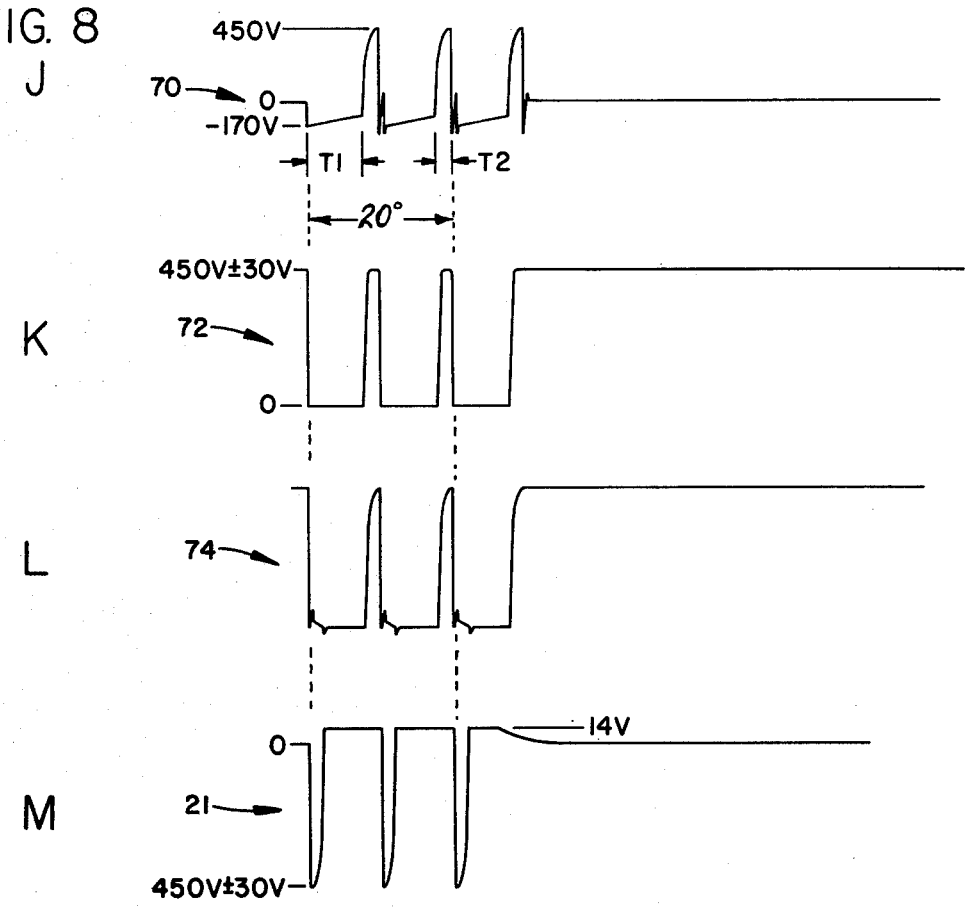

More particularly, in the signal conditioner 1, the opening of the points at the connection 116 applies a positive pulse through a capacitor C2 to a junction 52, as shown in FIG. 8A, and closing of the points applies a negative pulse. The positive pulses occur 90° apart in respect to engine rotation for the engine illustrated. The negative pulses are stopped by a diode D1, but the positive pulses are applied through the diode D1 to develop a comparable signal at a terminal 54, as shown in FIG. 8B.

Each positive pulse at the terminal 54 renders a transistor Q1 conductive to trigger the duration control 2. The duration control 2 is shown as a one-shot multivibrator in which the conduction by the transistor Q1 drops the signal at a junction 56 to ground, as shown in FIG. 8C. This signal is applied through a capacitor C5 to render a transistor Q3 non-conductive and causes the signal at a terminal 58 to go high, in turn holding a transistor Q2 on to keep the junction 56 at ground potential after the trigger pulse at the terminal 54 is removed. The transistor Q3 remains off until the capacitor C5 is charged through a resistor R7 to a potential turning on the transistor Q3. The capacitor C5 then discharges through resistors R6 and R7 until the next initiating pulse appears at the junction 52. As the pulses at the junction 52 occur periodically, the relative magnitudes of the resistances of the resistors R6 and R7 cause the output of the one-shot multivibrator 2 at the terminal 58 to be high for a substantially fixed fraction of each period between pulses at the junction 52 over a wide range of engine speeds. As shown in FIG. 8D, this fraction is about 20° for the circuit illustrated.

The signal at the terminal 58 is applied to activate the single shot comprising the multifiring unit 3. The signal is applied through a resistor R14 to a junction 60 to turn on the transistor Q6, rendering the transistor Q8 nonconductive and the transistor Q7 conductive. The conduction by the transistors Q6 and Q7 causes a junction 62 to go to ground, as shown in FIG. 8F (drawn to an expanded time scale), and thereby causes the flow of current through a resistor R16. This develops a potential across a resistor R15, delayed by a capacitor C15, to turn on a transistor Q4. This in turn turns on a transistor Q5 to drive the potential at the junction 60 low, as shown in FIG. 8E, to render the transistor Q6 non-conducting for a period T1 determined by the time interval required for a capacitor C8 to charge to a potential at a junction 64, as shown in FIG. 8G, that renders the transistor Q8 conductive. This time interval is substantially inversely proportional to the magnitude of the voltage of the battery from which it is charged through a resistor R17 and a transistor Q9. When the transistor Q8 is rendered conductive by the potential on the junction 64, the transistor Q7 becomes nonconductive. The potential at the junction 62 thereupon goes high, turning off the transistor Q4 after a time delay T2 caused by the capacitor C15. This permits the junction 60 to respond to the signal applied at the terminal 58. Thus the single shot is fired repetitively with a period equal to the sum of the time intervals T1 and T2 for the duration of the duration control signal at the terminal 58. This renders the transistor Q10 conductive for the intervals T1 and nonconductive for the intervals T2, producing the corresponding signal at a terminal 66, as shown in FIG. 8H.

The signal at the terminal 66 is applied to the DC-DC converter through a resistor R22 to turn on a transistor Q11 for the intervals T1 and turn it off for the intervals T2. This develops signals at a junction 68 and a terminal 70, as shown in FIGS. 8I and 8J respectively. This connects the battery in circuit with the primary winding 1-2 of the transformer T1 during each interval T1 and causes current to rise therein, transferring energy to the transformer core by way of the resulting magnetic field. During the intervals T2, the current is interrupted, causing the magnetic field to collapse.

Collapse of the magnetic field induces current to flow in the secondary winding 3-4 of the transformer T1 and through diodes D7 and D8 to charge a storage capacitor C10. The intervals T2 are set to permit substantially all of the energy in the magnetic field to be transferred to the capacitor C10 in the intervals T2. Once the capacitor C10 is charged, the diodes D7 and D8 disconnect the capacitor 10 from the secondary winding 3-4. These diodes D7 and D8 serve to keep the capacitor disconnected from the secondary winding 3-4 during the intervals T1 when energy is being introduced to the transformer core. The effect of this is to keep the capacitor C10 charged until it is discharged through the spark coil by action of SCR1, resulting in signals at junctions 72 and 74 as shown in FIGS. 8K and 8L, respectively, and applies a signal to the spark coil at the terminal 21, as shown in FIG. 8M. Further, because the diodes D7 and D8 decouple the capacitor C10 from the secondary winding 3-4 during energy input into the transformer core, the capacitor C10 can be discharged simultaneously with the build up of the magnetic field in the core. The signal at the terminal 66 operates, simultaneously with enabling of the transistor Q11, to trigger SCR1 to discharge the capacitor C10 through the spark coil. The charge is dissipated and the SCR1 turned off before the end of the intervals T1 so that SCR1 does not shunt power to ground when energy is transferred through the diodes D7 and D8 during respective subsequent intervals T2.

Figure 9:
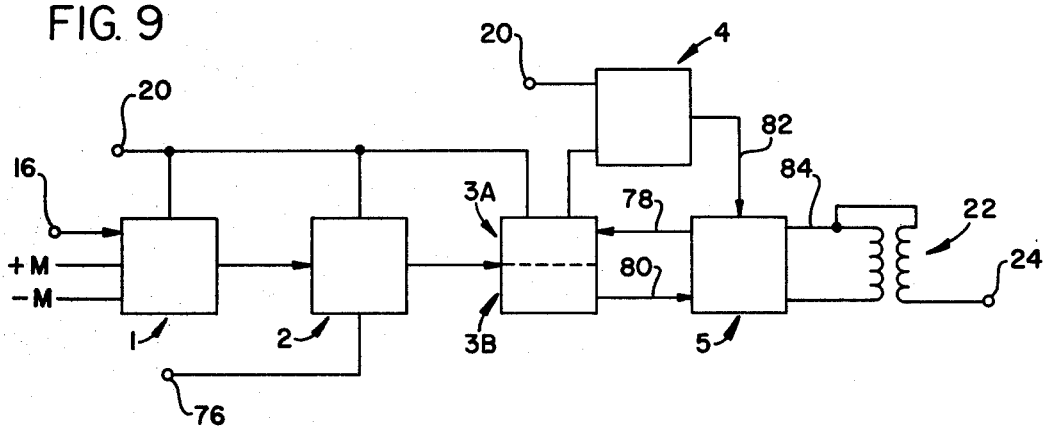
FIG. 9 is a diagrammatical illustration of still another embodiment of the present invention.
Figure 10:
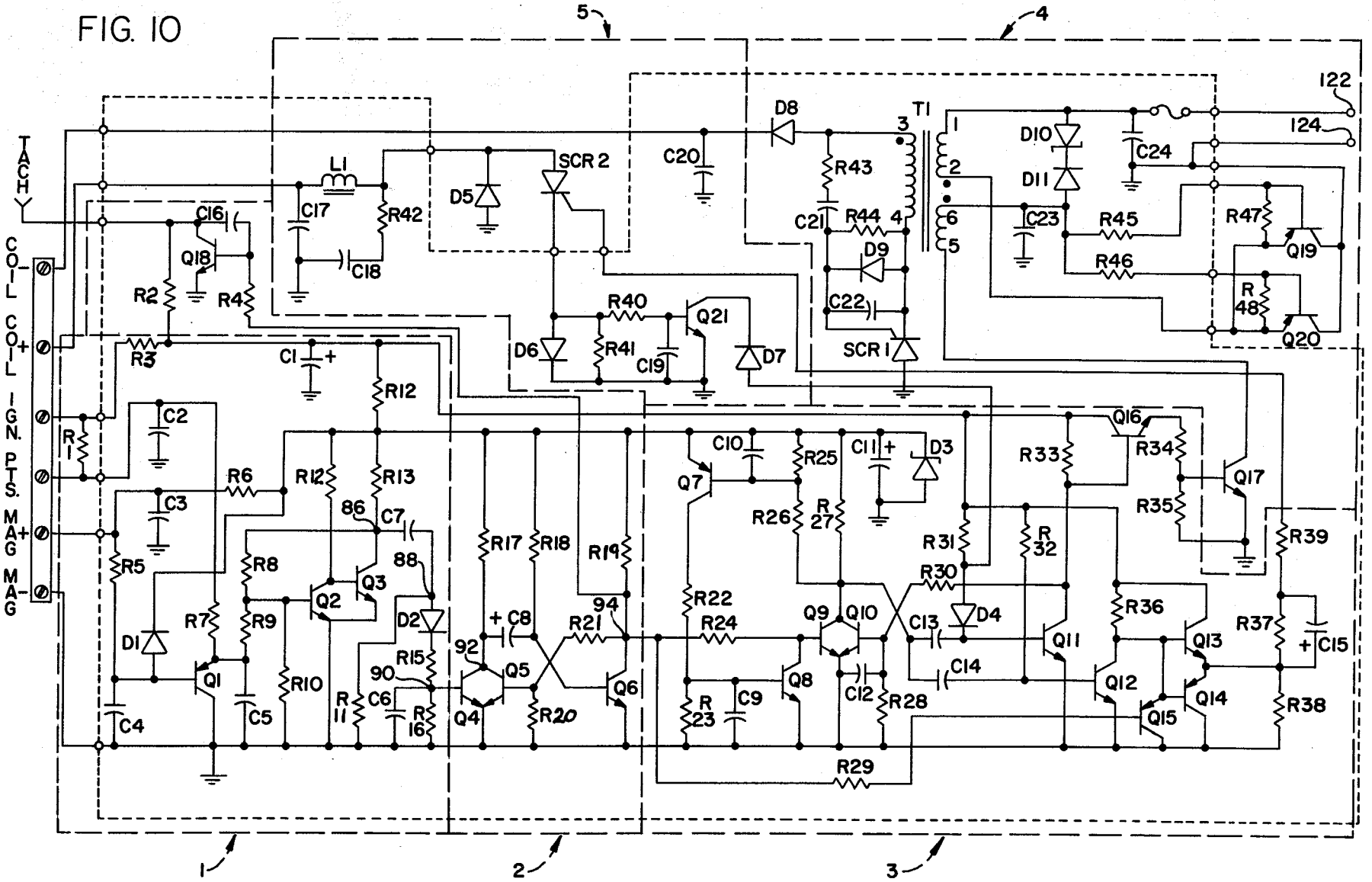
FIG. 10 is a schematical illustration of the details of the circuitry made in accordance with FIG. 9; and, FIGS. 11A–11T illustrate the voltage characteristics at various selected specific locations throughout the circuitry of FIGS. 9 and 10.

In FIG. 9 there is disclosed a diagrammatical representation of circuitry made in accordance with another form of this invention. FIG. 10 is a more detailed description of the circuitry of FIG. 9. As seen in FIGS. 9 and 10, the input signal conditioner 1 can be connected to a set of points 16 or to a magnetically triggered distributor at MAG + MAG−. The duration control 2 can be connected to a tachometer at 76 if desired. The duration control signal then goes to the converter control 3A - discharge control 3B, which in conjunction with the discharge circuit 5 and the converter circuit 4, provides a multiplicity of spark discharges for the time as prescribed by the duration control signal. The circuitry 3A, 3B, 4, and 5 are interrelated with one another as more specifically disclosed in the schematical illustration of FIG. 10.

Figure 11:
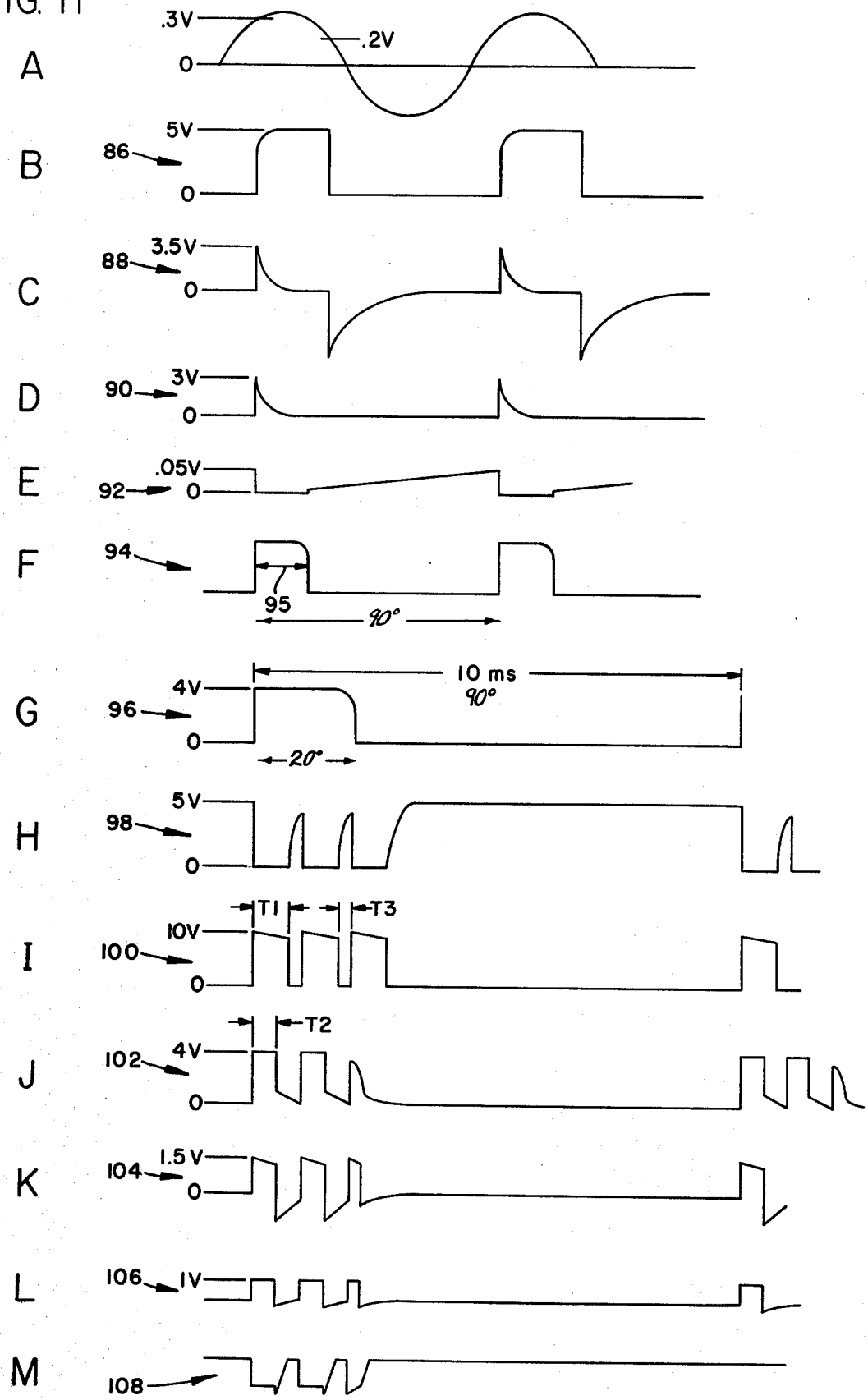
Figure 11:
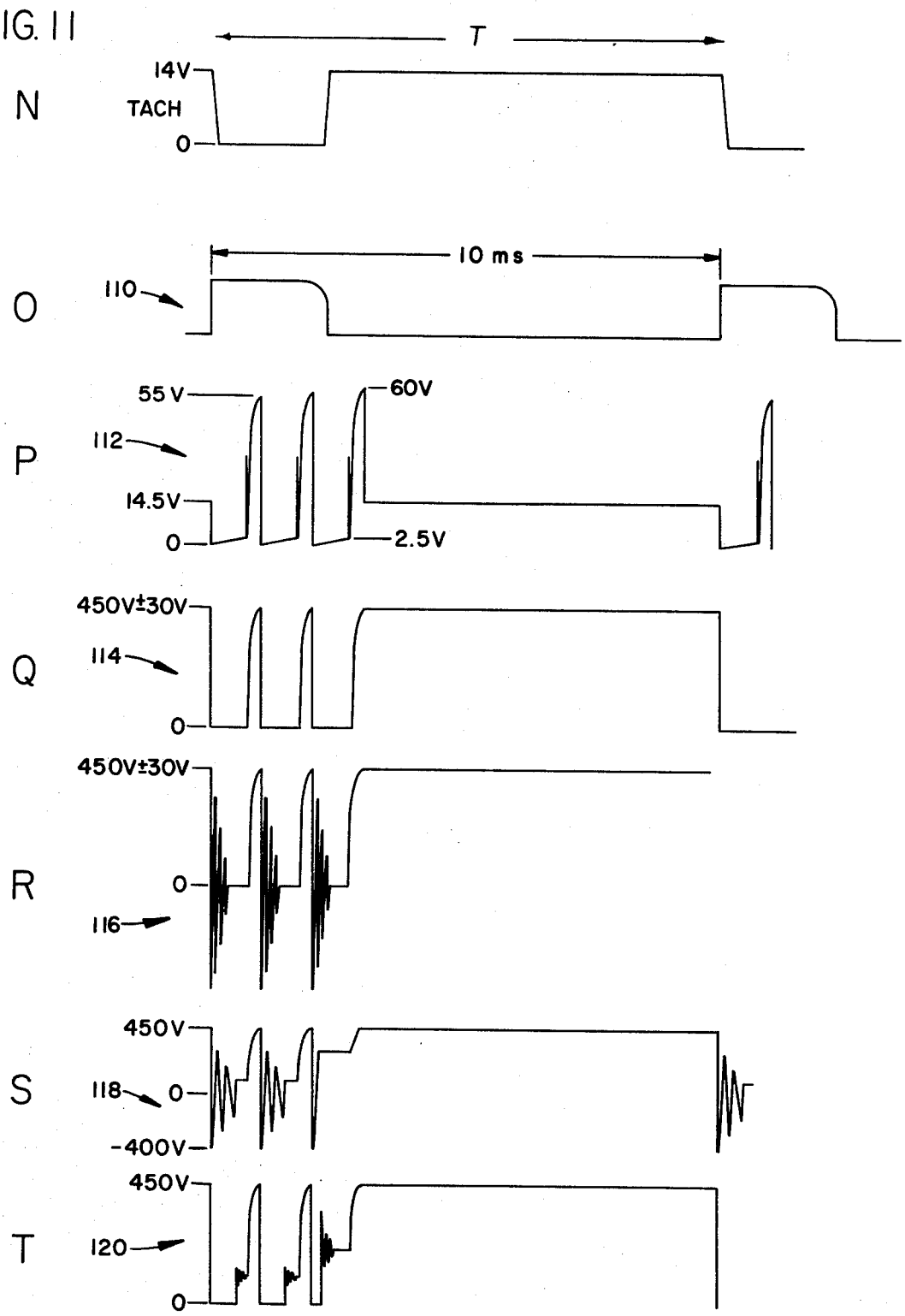

In this embodiment of the invention the signal conditioner 1 is in a form permitting input either from breaker points as in the embodiments of FIGS. 3 and 7, or from a magnetic timer as in the embodiments of FIG. 4. Input from breaker points is applied at a terminal PTS., and input from a magnetic timer is applied at terminals MAG+ and MAG−. The latter signal is shown in FIG. 11A.

When such signal is applied from a magnetic timer, no signal is applied at the terminal PTS. The signal of FIG. 11A is applied to an emitter follower circuit comprised of a transistor Q1 and thence to a trigger circuit comprised of transistors Q2 and Q3. When the applied signal level exceeds the trigger level across a resistor R10, the trigger circuit responds to produce at a junction 86 a signal as illustrated in FIG. 11B. The part of the circuit following the junction 86 is substantially identical to the embodiment of the signal conditioner 1 as shown in FIG. 7 and operates in the same manner to develop a signal on a junction 88 as shown in FIG. 11C and a signal on a terminal 90 as shown in FIG. 11D.

When input is provided from breaker points at the terminal PTS., the transistor Q1 is biased to cut-off, and the breaker points input is applied to the trigger circuit comprised of the transistor Q2 and Q3 to develop a corresponding signal at the junction 86.

Whichever input is provided, the output signal at the terminal 90 is applied to the duration control circuit 2 which is shown in FIG. 10 to be identical to that shown in FIG. 7. The circuit 2 thus operates as described above to produce signals at a junction 92 and a terminal 94 as shown in FIGS. 11E and 11F, respectively. The duration of the pulses is shown at 95 and may, as shown, be equivalent to 20° of engine rotation. The signal at the terminal 94 is drawn to a different time scale in FIG. 11G, as it appears at the input terminal 96 of the control circuit 3A, 3B.

The circuitry set forth in blocks 3A and 3B of FIG. 9 is basically a single shot multivibrator with two outputs. The 3A output controls the energy storage in the inductance of T1 by switching on Q17, Q19, and Q20 thus applying essentially battery voltage across winding 1-2 of T1. The 3A output time and thus energy stored is determined by R31 and C13. The circuit 3A of FIG. 10 is substantially the same as the control multi-firing circuit 3 shown in FIG. 7 and operates as described above to produce signals at junctions 98 and 100 as shown in FIGS. 11H and 11I, respectively. The control signal at the junction 100 operates through transistors Q16 and Q17 as in the circuit of FIG. 7 to control the operation of the DC—DC converter circuit 4 to store energy in the core of a transformer T1 and then transfer the energy through the secondary winding 3-4 thereof.

The circuit 3B of FIG. 10 provides a second output from the multi-firing circuit 3, but does not provide feedback to the input at the terminal 100 to reset the multivibrator. Rather, it provides a shorter time constant and hence an earlier output timing signal than the circuit 3A. The 3B output time T3 is determined by R32 and C14. The signal developed on the capacitor C14 controls a transistor Q12 which in turn controls a transistor Q13 to develop at a junction 102 a control signal as shown in FIG. 11J. This signal is applied through a resistor R37 in parallel with a capacitor to develop at a junction 104 a corresponding control signal as shown in FIG. 11K. This signal is applied through a resistor R39 and over a conductor 80 to provide at a terminal 106 a suitable signal as shown in FIG. 11L which is used to trigger the discharge of C20 through the ignition coil primary through SCR2.

The discharge of C20 is oscillatory with a frequency determined by the LC circuit composed of the leakage inductance of the ignition coil together with the energy storage capacitor C20. The oscillating voltage across C20 during discharge is isolated from the converter 4 by SCR1 which is off except when energy is being transferred from the inductance of T1 to the energy storage capacitor C20 in preparation for the next discharge. SCR1 is rendered conductive when the terminal 3 of the transformer T1 is driven positive relative to the terminal 4 during collapse of the field in the transformer T1. The duration of the 3B output of the single shot is made shorter in time than the 3A output to allow sufficient time for SCR2 to turn off prior to the converter 4 recharge of energy storage capaciter C20. An additional interlock is provided by the circuitry of D6, R40, R41, C19, Q21 and D7, which prevents the converter circuit from attempting to recharge C20 until SCR2 is in fact off as sensed by the voltage across D6. That is, the voltage developed across the diode D6 and the resistor R41 when the SCR2 is conducting acts to turn on the transistor Q21, developing on a conductor 108 connected to the collector of the transistor Q21 a signal as shown in FIG. 11M. This signal acts through the diode D7 and over a conductor 78 to shunt the current through the resistor R31. This keeps the control signal at the terminal 100 high until after the current through SCR2 first goes to zero following termination of the trigger pulse at the terminal 106. It is only then that the capacitor C13 may charge through the resistor R31 sufficiently to cause a transistor Q11 to conduct.

The triggering of the single shot with resulting multiple spark discharges is initiated by the duration control signal turning on Q9 through R24. When the single shot is triggered, the resulting current flow through R26 turns on Q7 which turns on Q8 thereby shunting the current away from the base of Q9. At the end of the 3A time of the single shot, as determined by R31 and C13, Q10 turns off. This action allows the voltage at Q10 to rise with a time constant essentially determined by R27, C13, and C14. This time constant is made of sufficient duration to enable the resonant transfer of energy from the inductance of T1 to the energy storage capacitor C20 through a conductor 82, a diode D8, the secondary winding 3-4 of T1 and SCR1. At the end of this time constant Q7 and Q8 turn off allowing the current through R24 from the duration control to retrigger the single shot and thus providing a multiplicity of ignition sparks of a duration determined by the duration control circuit. The duration control signal as developed at the terminal 94 is applied through a transistor Q18 to the terminal 76 as shown in FIG. 11N.

The duration control signal is also applied over a conductor 110 in the form shown in FIG. 110. At the end of the prescribed firing duration as determined by the duration control circuit, SCR2 is immediately turned off at the next current reversal by means of R29, Q15, Q14, C15 and R39, which reverse biases the gate of SCR2 at the end of the duration signal. This cuts off any signal applied through the transistor Q13. This is required for exceptionally high rpm engines to prevent cross-firing at the distributor as will be appreciated by those skilled in the art. Following the turn off of SCR2 at the end of the 3A time, the energy stored by the converter circuit in the inductance of T1 is transferred to energy storage capacitor C20 to provide energy for the first spark of the next cylinder firing. The signal developed at a terminal 112 connected to the terminal 2 of the transformer T1 is shown in FIG. 11P. The signal developed across the SCR2 at a junction 114 is shown in FIG. 11Q and results in an output signal over a conductor 84 to the ignition coil at a terminal 115 as shown in FIG. 11R. Where the ignition coil and storage capacitor C20 resonate at a higher frequency the signals at terminals 115 and 114 are as shown in FIGS. 11S and 11T, respectively.

The battery is connected between terminals 122 and 124.

Figure 3 values of circuit components:

| | | | | | |
|---|---|---|---|---|---|
| C1 | 0.01 mf | Q1 | 2N2222 | R1 | 40 Ω |
| C2 | .01 | Q2 | 2N2222 | R2 | 120 |
| C3 | .1 ; 16v | Q3 | 2N2222 | R3 | 100 |
| C4 | .001; 1kv | Q4 | 2N2222 | R4 | 10 |
| C5 | 2.2; 35v | Q5 | 2N2222 | R5 | 10 |
| C6 | .033; 500v | Q6 | MJE 520 | R6 | 62 |
| C7 | .033; 500v | Q7 | MJE 520 | R7 | 22 |
| C8 | .1; 16v | Q8 | 5VT 6102 | R8 | 47 |
| C9 | .1; 400v | D1 | IN 4001 | R9 | 47 |
| C10 | .01 | D2 | IN 5231 | R10 | 4.7K |
| C11 | .001 | D3 | IN 4001 | R11 | 470 |
| URI-U130LA20A | | D4 | IN 4001 | R12 | 10K |
| | | | | R13 | 27K |
| | | | | R14 | 470 |
| | | | | R15 | 40 |
| | | | | R16 | 100 |
| | | | | R17 | 0.15 |

Figure 4 values of circuit components:

| | | | |
|---|---|---|---|
| C1 | .001 | R1 | 1M |
| C2 | .001 | R2 | 10K |
| C3 | .001 | R3 | 22K |
| C4 | .01 | R4 | 6.8K |
| C5 | .001 | R5 | 130K |
| Q1 | 2N2906 | R6 | 22K |
| Q2 | 2N2222 | R7 | 4.7K |
| Q3 | 2N2222 | R8 | 120 Ω |
| D1 | IN 4001 | R9 | 10K |
| D2 | IN 4001 | R10 | 10K |
| | | R22 | 100K |
| | | R24 | 10K |

Figure 7 values of circuit components:

| | | | | | |
|---|---|---|---|---|---|
| C1 | 33μf | Q1 | 2N2222 | R. | 40 Ω |
| C2 | .01 | Q2 | 2N2222 | R2 | 10 |
| C3 | .01 | Q3 | 2N2222 | R3 | 100K |
| C4 | .001 | Q4 | 2N2222 | R4 | 10K |
| C5 | 2.2 | Q5 | 2N2222 | R5 | 10K |
| C6 | 5μf | Q6 | 2N2222 | R6 | 33K |
| C7 | .01 | Q7 | 2N2222 | R7 | 10K |
| C8 | .047 | Q8 | 2N2222 | R8 | 10K |
| C9 | .01 | Q9 | 2N2906 | R9 | 10K |
| C10 | 1 μf | Q10 | 2N2222 | R10 | 2.2K |
| C11 | .01 | Q11 | D44H8 | R11 | 120 |
| C12 | .1 | Q12 | S41973 | R12 | 10K |
| C13 | 1μf | Q13 | S41973 | R13 | 10K |
| C14 | .02 | | | R14 | 10K |
| C15 | .01 | | | R15 | 10K |
| | | D1 | IN 4001 | R16 | 1.3K |
| | | D2 | IN 5231 | R17 | 39K |
| | | D3 | IN 4001 | R18 | 10K |

-continued

| | | | |
|---|---|---|---|
| D4 | IN 4001 | R19 | 10K |
| D5 | MR 756 | R20 | 10K |
| D6 | IN 5062 | R21 | 1K |
| D7 | IN 5062 | R22 | 47K |
| D8 | IN 5062 | R23 | 100 |
| D9 | IN 5262 | R24 | 10 |
| D10 | IN 4001 | R25 | 200 |
| | | R26 | 20 |
| | | R27 | 2 Ω |
| | | R28 | 10 Ω |
| | | R29 | 1 Ω |
| | | R30 | 1 Ω |
| | | R31 | 10 Ω |
| | | R32 | 10 Ω |

Figure 10 values of Circuit components:

| | | | | | |
|---|---|---|---|---|---|
| R1 | 40 Ω | Q1 | 2N2906 | D1 | IN4154 |
| R2 | 270 | Q2 | 2N2222 | D2 | IN4154 |
| R3 | 10 | Q3 | 2N2222 | D3 | IN5231 |
| R4 | 2.7K | Q4 | 2N2222 | D4 | IN4154 |
| R5 | 10K | Q5 | 2N2222 | D5 | MR 756 |
| R6 | 1M | Q6 | 2N2222 | D6 | IN4154 |
| R7 | 39K | Q7 | 2N2906 | D7 | IN4001 |
| R8 | 430K | Q8 | 2N2222 | D8 | IN5062 |
| R9 | 6.8K | Q9 | 2N2222 | D9 | IN5262 |
| R10 | 10K | Q10 | 2N2222 | D10 | IN4001 |
| R11 | 100K | Q11 | 2N2222 | D11 | MR1126R |
| R12 | 22K | Q12 | 2N2222 | | |
| R13 | 4.7K | Q13 | 2N2222 | | |
| R14 | 120 | Q14 | 2N6015 | | |
| R15 | 10K | Q15 | 2N2906 | | |
| R16 | 10K | Q16 | 2N2222 | SCR1 | 52600M |
| R17 | 47K | Q17 | | SCR2 | S6220M |
| R18 | 10K | Q18 | 2N2222 | | |
| R19 | 1K | Q19 | S41973 | | |
| R20 | 10K | Q20 | S41973 | | |
| R21 | 10K | Q21 | 2N2222 | | |
| R22 | 10K | | | | |
| R23 | 10K | | | | |
| R24 | 10K | | | | |
| R25 | 10K | | | | |
| R26 | 10K | | | | |
| R27 | 1.5K | | | | |
| R28 | 1K | | | | |
| R29 | 10K | | | | |
| R30 | 10K | | | | |
| R31 | 27K | C1 | .01 MF; | 50v | |
| R32 | 1K | C2 | .001 | 1kv | |
| R33 | 1K | C3 | .001 | 1kv | |
| R34 | 47 Ω | C4 | .001 | 1kv | |
| R35 | 100 | C5 | .01 | 50v | |
| R36 | 10 | C6 | .001 | 1kv | |
| R37 | 100 | C7 | 2.2 | 35v | |
| R38 | 220 | C8 | .047 | | |
| R39 | 22 Ω | C9 | .047 | | |
| R40 | 100 | C10 | 5 | 25v | |
| R41 | 100 | C11 | 5 | 25 | |
| R42 | 10K | C12 | .01 | 50 | |
| R43 | 1K | C13 | .01 | 1kv | |
| R44 | 1 Ω | C14 | .02 | 600 | |
| R45 | 1Ω | C15 | .01 | 50 | |
| R46 | 10 | C16 | .01 | 1kv | |
| R47 | 10 | C17 | .01 | 50 | |
| | | C18 | .1 | 100 | |
| | | C19 | | | |
| | | C20 | 1 MF | 100v | |
| | | C21 | 1 MF | 600v | |

I claim:

1. In an internal combustion engine having a source of DC current, a spark gap connected to ignite a combustible mixture contained within a combustion chamber thereof in timed relationship respective to the power stroke thereof, and means generating a timing signal in timed relationship to the power stroke of the piston, the combination with said internal combustion engine of a multi-spark discharge system comprising means forming an input signal conditioner by which the timing signal is treated to produce a corresponding input signal; a firing duration control circuit by which the duration of time within which the multi-spark discharge occurs is determined; circuit means connecting said input signal to said duration control circuit so that said input signal initiates operation of said duration control circuit; a repetition rate control for determining the number of sparks occurring with the time duration provided by said duration control circuit; a high voltage discharge circuit for providing a high tension discharge across said spark gap; circuit means connecting said duration control circuit to said repetition rate control and said repetition rate control to said high voltage discharge circuit, whereby said conditioned input signal causes the firing duration control circuit to initiate operation of said repetition rate control which in turn causes said high voltage discharge circuit to discharge across the spark gap in proper timed relation respective to the power stroke of the engine; said high voltage discharge circuit including a power darlington connected to be triggered by said repetition rate control, said rate control determining the number of times said power darlington is turned on during the time interval provided by said duration control.

2. The combination of claim 1 wherein said duration control and said repetition rate control provide a series of sparks at all speeds which increases in number during each said time duration at low engine speeds.

3. In an internal combustion engine having a combustion chamber within which an ignition spark is to be provided with the spark occurring in timed sequence respective to engine rotation, said engine having means providing a timing signal, a DC current source, and a distributor connected to deliver high voltage current for the spark, a multiple spark discharge apparatus for delivering current to the distributor in response to said timing signal, said discharge apparatus comprising means forming a multiple spark discharge control circuit connected to deliver multiple strikes for said spark when said circuit is energized, said control circuit including a repetition rate control means which determines the number of electrical discharges within the combustion chamber, and a duration control means which determines the time duration of the multi-discharge within the combustion chamber; an input signal conditioner by which said timing signal is treated to provide said duration control means with a distinct signal having a single wave form which rapidly increases to a value suitable for initiating the action of the duration control; a power darlington which is connected to be turned on a plurality of times by said repetition rate control means; a transistor which shunts current away from the base of the power darlington to limit current flow therethrough; and means mounting said transistor and said power darlington onto a common heat sink so that as the transistor increases in temperature the voltage required at the base thereof in order to turn off the power darlington is decreased in proportion to the temperature.

4. In an internal combustion engine having a combustion chamber within which an ignition spark is to be provided with the spark occurring in timed sequence respective to engine rotation, said engine having means providing a timing signal, a DC current source, and a distributor connected to deliver high voltage current for the spark, a multiple spark discharge apparatus for delivering current to the distributor in response to said timing signal, said discharge apparatus comprising means forming a multiple spark discharge control circuit connected to deliver multiple strikes for said spark when said circuit is energized, said control circuit including a repetition rate control means which determines the number of electrical discharges within the combustion chamber, and a duration control means which determines the time duration of the multidischarge within the combustion chamber; an input signal conditioner by which said timing signal is treated to provide said duration control means with a distinct signal having a single wave form which rapidly increases to a value suitable for initiating the action of the duration control; a power darlington connected to be triggered by said repetition rate control, said rate control determining the number of times said power darlington is turned on during the time interval provided by said duration control.

5. In a multiple spark ignition system for developing multiple sparks in the spark gap of a combustion chamber of an internal combustion engine by dicharging a storage capacitor through a spark coil periodically a plurality of times during a timed portion of each operational cycle of the chamber, the timed portions being defined by duration control signals from a firing duration control circuit, and the capacitor being chargeable from a DC power supply, the improvement comprising a transformer having a primary winding and a secondary winding, and cyclic switching means responsive to said duration control signals for cyclically coupling said DC power supply to said primary winding and said capacitor to said secondary winding and said spark coil a plurality of times during each timed portion, the periods of such coupling of said DC power supply to said primary winding being in alternating first and second intervals, each first interval being that part of a respective period wherein said DC power supply is coupled to said primary winding to supply power thereto and build up a magnetic field therein and each second interval being the remainder of a respective period wherein said DC power supply is substantially decoupled from said primary winding to cause said magnetic field to collapse, said capacitor being coupled to said secondary winding only during said second intervals and to said spark coil only during said first intervals.

6. Apparatus according to claim 5 wherein said switching means acts to decouple said spark coil from said capacitor before the end of each of said first intervals.

7. Apparatus according to claim 5 wherein said switching means acts substantially coincidentally to couple said capacitor to said spark coil and decouple said capacitor from said secondary winding and to couple said DC power supply to said primary winding.

8. Apparatus according to claim 5 including means coupled to said DC power supply for varying the duration of said first interval inversely with the voltage of said power supply.

9. Apparatus according to claim 8 wherein the duration of each of said first intervals is inversely proportional to the voltage of said power supply.

10. Apparatus according to claim 5 wherein said switching means operates to complete any cycle begun during any such timed portion.

11. Apparatus according to claim 5 wherein said duration of each of said second intervals is at least the time for the resonant transfer of energy from said transformer to said capacitor.

12. Apparatus according to claim 5 including means responsive to said firing duration control signal for decoupling said capacitor from said spark coil at the end of said timed portion, irrespective of when this occurs during a cycle of said switching means.

13. In a multiple spark ignition system for developing multiple sparks in the spark gap of a combustion chamber of an internal combustion engine by discharging a storage capacitor through a spark coil periodically a plurality of times during a timed portion of each operational cycle of the chamber, the timed portions being defined by duration control signals from a firing duration control circuit, and the capacitor being chargeable from a DC power supply, the improvement comprising a transformer having a primary winding and a secondary winding, cyclic switching means responsive to said duration control signals for cyclically coupling said DC power supply to said primary winding and said capacitor to said secondary winding and said spark coil a plurality of times during each such timed portion, the periods of such coupling of said DC power supply to said primary winding being in alternating first and second intervals, each first interval being that part of a respective period wherein said DC power supply is coupled to said primary winding to supply power thereto and build up a magnetic field therein and each second interval being the remainder of a respective period wherein said DC power supply is substantially decoupled from said primary winding to cause said magnetic field to collapse, and means coupled to said DC power supply for varying the duration of each of said first intervals inversely with the voltage of said DC power supply.

14. Apparatus according to claim 13 wherein the duration of each of said first intervals is inversely proportional to the voltage of said power supply.

15. Apparatus according to claim 14 wherein the duration of each of said second intervals is at least the time for the resonant transfer of energy from said transformer to said capacitor.

16. Apparatus according to claim 13 wherein the duration of each of said second intervals is at least the time for the resonant transfer of energy from said transformer to said capacitor.

17. Apparatus according to claim 13 wherein said cyclic switching means includes a one-shot multivibrator producing output signals the duration of which establishes the duration of said first intervals, said multivibrator having a timing capacitor and the duration of each of said output signals being the time for charging said timing capacitor to a predetermined voltage, and said means for varying the duration of said first intervals includes means for applying current from said DC power supply to charge said timing capacitor.

18. Apparatus according to claim 17 wherein said means for applying current includes means for applying such current substantially in proportion to the voltage of said DC power supply and substantially independently of the charge on said timing capacitor.

19. In a multiple spark ignition system for developing multiple sparks in the spark gap of a combustion chamber of an internal combustion engine by discharging a storage capacitor through a spark coil periodically a plurality of times during a timed portion of each operational cycle of the chamber, the timed portions being defined by duration control signals from a firing duration control circuit, and the capacitor being chargeable from a DC power supply, the improvement comprising a transformer having a primary winding and a secondary winding, cyclic switching means responsive to said duration control signals for cyclically coupling said DC power supply to said primary winding and said capacitor to said secondary winding and said spark coil a plurality of times during each such timed portion, the periods of such coupling of said DC power supply to said primary winding being in alternating first and second intervals, each first interval being that part of a respective period wherein said DC power supply is coupled to said primary winding to supply power thereto and build up a magnetic field therein and each second interval being the remainder of a respective period wherein said DC power supply is substantially decoupled from said primary winding to cause said magnetic field to collapse, and means responsive to said duration control signals for decoupling said capacitor from said spark coil at the end of said timed portion, irrespective of when this occurs in a cycle of said switching means.

* * * * *